US006073758A

United States Patent [19]

Webster et al.

[11] Patent Number: 6,073,758

[45] **Date of Patent: *Jun. 13, 2000**

[54] FOLDOVER MERCHANDISING PACKAGE

[76] Inventors: Anne C. Webster, 44 Bassett Ave., Warwick, R.I. 02889; Bernard M. Maceroni, 141 Freeman Pkwy.; Heidi J. Loomis, 16 Freeman Pkwy., both of Providence, R.I. 02906

[ * ] Notice: This patent issued on a continued prosecution application filed under 37 CFR 1.53(d), and is subject to the twenty year patent term provisions of 35 U.S.C. 154(a)(2).

[21] Appl. No.: 09/243,849

[22] Filed: Feb. 3, 1999

[51] Int. Cl.[7] ..... A45C 11/04

[52] U.S. Cl. ..... 206/6.1; 206/566; 206/523; 206/806

[58] Field of Search ..... 206/6.1, 566, 806, 206/523, 784, 525.1, 227, 63.3, 49, 303, 225, 521, 461, 470, 495, 493, 348; 40/639

[56] References Cited

U.S. PATENT DOCUMENTS

| | | | |
|---|---|---|---|
| 840,487 | 1/1907 | Goldsmith | 40/639 |
| 857,778 | 6/1907 | Wittstein | 40/639 |
| 899,778 | 9/1908 | Wittstein | 40/639 |
| 1,742,982 | 1/1930 | Wittstein | 40/639 |
| 2,321,534 | 6/1943 | Warren | 206/806 |
| 2,624,457 | 1/1953 | Jablon . | |
| 3,650,382 | 3/1972 | Braun et al. . | |
| 3,769,741 | 11/1973 | Hessler et al. | 206/523 |
| 4,157,758 | 6/1979 | Kozlowski, Jr. . | |
| 4,175,660 | 11/1979 | Feibelman . | |
| 4,241,829 | 12/1980 | Hardy | 206/591 |
| 4,315,569 | 2/1982 | Jaeschke . | |
| 4,518,086 | 5/1985 | Roccaforte | 206/485 |
| 4,735,246 | 4/1988 | Niehaus . | |
| 4,760,920 | 8/1988 | Thomsen | 206/495 |
| 4,944,389 | 7/1990 | Robertson . | |
| 4,958,727 | 9/1990 | Bergeron | 206/6.1 |
| 5,025,918 | 6/1991 | Bergeron | 206/493 |
| 5,048,676 | 9/1991 | Borgis et al. | 206/806 |
| 5,390,794 | 2/1995 | Vulpitta | 206/459.1 |
| 5,425,444 | 6/1995 | Chapman . | |
| 5,582,291 | 12/1996 | Schroeder et al. . | |
| 5,664,669 | 9/1997 | VanFleet | 206/6.1 |
| 5,709,297 | 1/1998 | Brandriff et al. . | |
| 5,720,498 | 2/1998 | McAuley et al. | 283/79 |
| 5,775,504 | 7/1998 | Menaged . | |
| 5,915,564 | 6/1999 | Hsi-Chang | 206/784 |

*Primary Examiner*—Paul T. Sewell
*Assistant Examiner*—Nhan T. Lam
*Attorney, Agent, or Firm*—Sampson & Associates

[57] ABSTRACT

A foldover tag for jewelry items such as necklaces and bracelets includes a web fabricated from cardboard with a resilient foam rubber pad centrally disposed thereon. The pad includes a recess adapted to receive a clasp or fastener of the jewelry item therein. The foldover card is adapted for being folded about a transversely disposed foldline to effectively capture a portion of the jewelry item between front and rear portions of the card, and to secure the clasp within the recess of the pad. The present invention thus advantageously secures the clasp portion of the jewelry item in concealed relation within the foldover card during shipment and retail display of the jewelry item.

25 Claims, 3 Drawing Sheets

FOLDOVER MERCHANDISING PACKAGE

BACKGROUND OF THE INVENTION

1. Field of the Invention

The present invention relates to merchandise packaging, and more particularly to a point-of-sale display card for jewelry and the like.

2. Background Information

A wide variety of merchandising and/or display cards are known for displaying various products for sale in retail establishments. For example, display cards are commonly used for earrings and other small, high volume costume jewelry items, and are often used in conjunction with a dedicated display on top of a display counter or a free-standing display rack in a department or other retail store. One example of a jewelry display card is disclosed in U.S. Pat. No. 5,709,297. Such a device may adequately secure earrings thereto due to the ease with which the stud or fastener portion of the earring may be fastened to the card. However, difficulties arise when attempting to utilize such conventional display cards in conjunction with larger, loop-type jewelry items such as necklaces and bracelets.

One technique for displaying such loop-type jewelry is to provide a foldable card which is adapted for being folded over the clasp or fastener portion of the necklace or bracelet. This approach generally adequately secures the jewelry item to the card for display, however, the jewelry item tends to slide within the card during handling, i.e. during shipment to the retailer and/or by shoppers once displayed. This sliding action undesirably enables the clasp or fastener to slide out of the card where it is exposed to potential purchasers, thereby detracting from the visual impression generated by the displayed merchandise. The necklaces and/or bracelets then must be manually adjusted by the retailer to re-conceal the clasp within or behind the card for proper display.

One approach intended to eliminate the need for such adjustment by the retailer is to effectively eliminate slippage by gluing the jewelry to the card. While this approach may substantially reduce the need for manual adjustment of the jewelry on display, it tends to be problematic for the ultimate purchaser of the jewelry item. In particular, the adhesive tends to complicate removal of the display card and leaves residue on the jewelry item which may be difficult to remove and/or tarnish or damage the jewelry item.

Thus, a need exists for an improved display card which conveniently displays a necklace or bracelet jewelry item by securely engaging the fastener portion thereof, while also being easily removed by a consumer.

SUMMARY OF THE INVENTION

According to an embodiment of this invention, a package for displaying jewelry and the like, includes a web adapted for being folded to capture a jewelry item between a first portion and a second portion thereof. At least one pad is disposed on the web between the folded first and second portions, to conformably engage the jewelry item to retain the jewelry item between the first and second portions.

The present invention provides, in a second aspect, a method for displaying jewelry, the method including the steps of:

(a) providing a web adapted for being folded to capture a jewelry item between a first portion and a second portion thereof;

(b) disposing at least one pad on the web, wherein the pad is adapted for being disposed between the folded first and second portions;

(c) placing the jewelry item between the first and second portions wherein the jewelry item is conformably engaged by the at least one pad.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
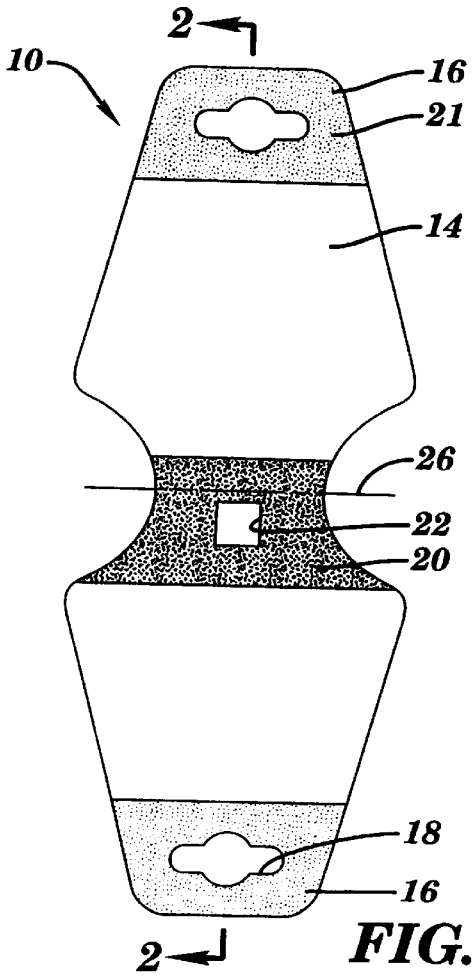
FIG. 1 is a plan view of an embodiment of a foldover card of the present invention, in its unfolded orientation.
Figure 7:
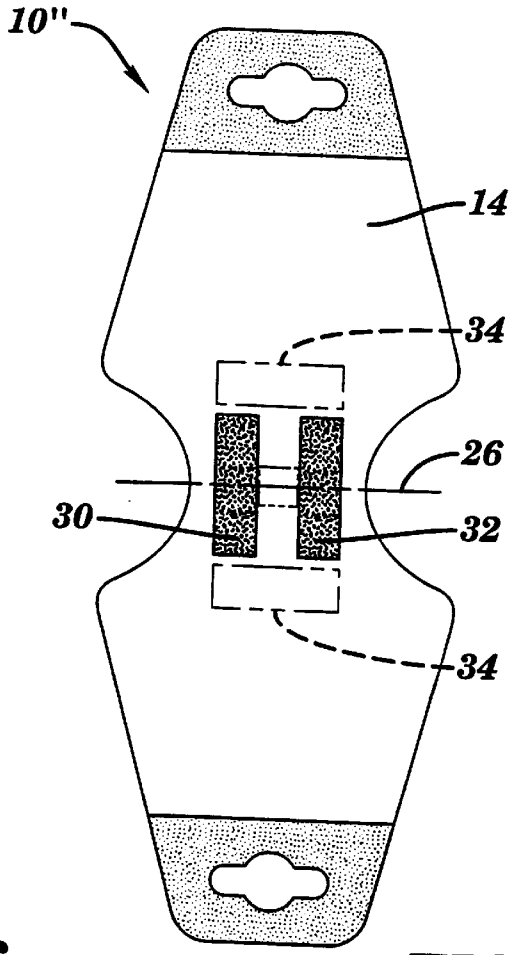
FIG. 7 is a view similar to that of FIG. 5, of a further embodiment of the foldover card of the present invention with optional components thereof shown in phantom.
Figure 5:
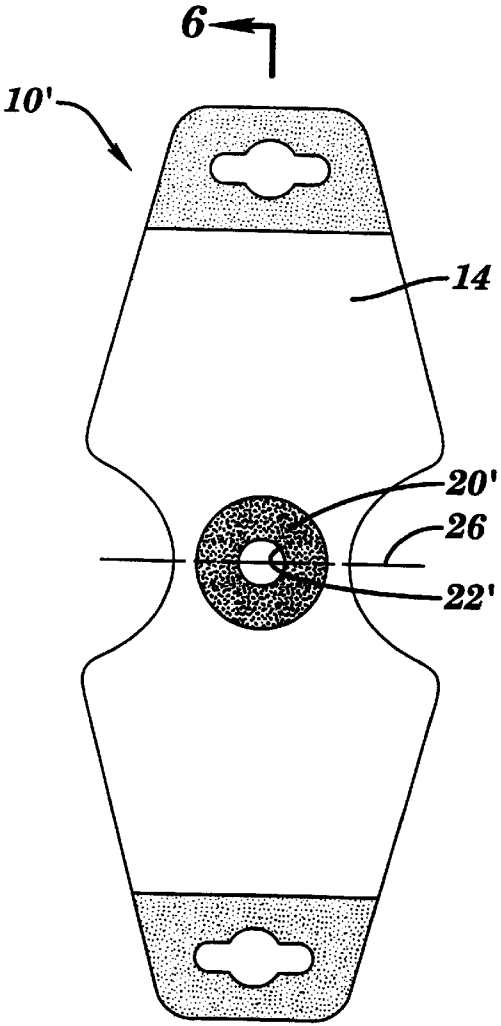
FIG. 5 is a view similar to FIG. 1, of an alternate embodiment of the foldover card of the present invention.

Referring to the figures set forth in the accompanying Drawings, the illustrative embodiments of the present invention will be described in detail hereinbelow. For clarity of exposition, like features shown in the accompanying Drawings shall be indicated with like reference numerals and similar features as shown in alternate embodiments in the Drawings shall be indicated with similar reference numerals.

Where used in this disclosure, the term "transverse" when used in connection with a foldover card described herein, shall refer to a direction relative to the card, which is substantially parallel to its foldline 26 as shown in FIGS. 1, 5 and 7. Similarly, the term "longitudinal" shall refer to a direction substantially orthogonal to the transverse direction.

Figure 4:
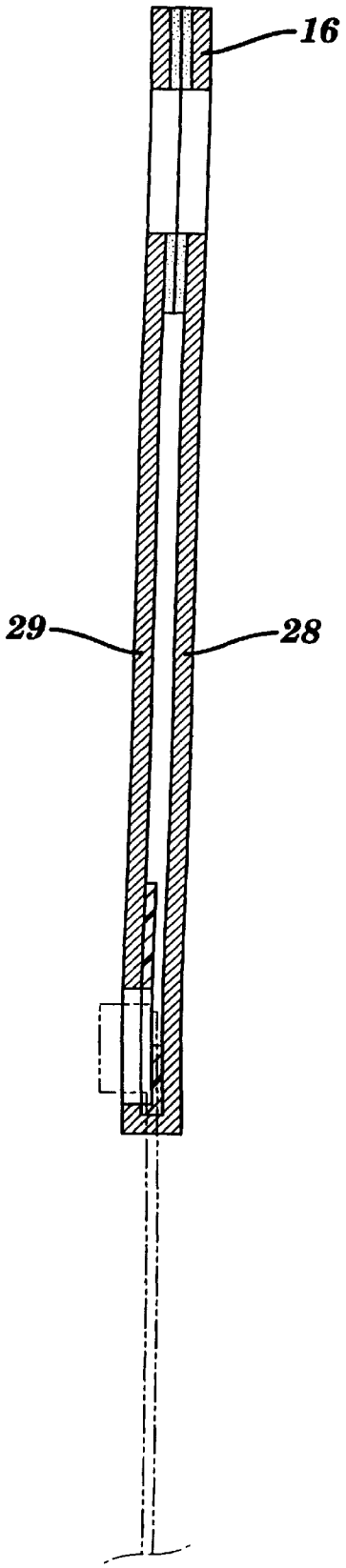
FIG. 4 is a cross-sectional view, on an enlarged scale, taken along 4—4 of FIG. 3.

Referring to FIG. 1, foldover tag, or card package 10 constructed according to the principles of the present invention is shown. The tag 10 includes a web 14 fabricated from cardboard, paperboard or other suitable sheet material, such as plastic, (i.e. polyethylene, Mylar®, etc.) nylon (polyamide) and Tyvek®, etc. The web is substantially hourglass shaped to facilitate engagement with a jewelry item as discussed hereinabove. The web 14 is adapted for being folded about a transversely oriented foldline 26 disposed substantially centrally on web 14, so that opposite ends 16 are mutually engagable in superposed orientation as shown in FIG. 4, and as will be discussed in greater detail hereinbelow. In a preferred embodiment, as shown, opposite ends 16 are coated with an adhesive 20 to facilitate and maintain their mutual engagement. The ends 16 also are provided with apertures 18 adapted for superposed alignment with one another to facilitate hanging the card 10 on a conventional retail display rack in a manner familiar to those skilled in the art. Although the foldline is preferably disposed centrally within web 14 as shown, foldline 26 may be disposed off-center on the web, with the card adapted for being hung from an aperture 18 in only one of the ends 16, without departing from the spirit and scope of the present invention.

Figure 2:
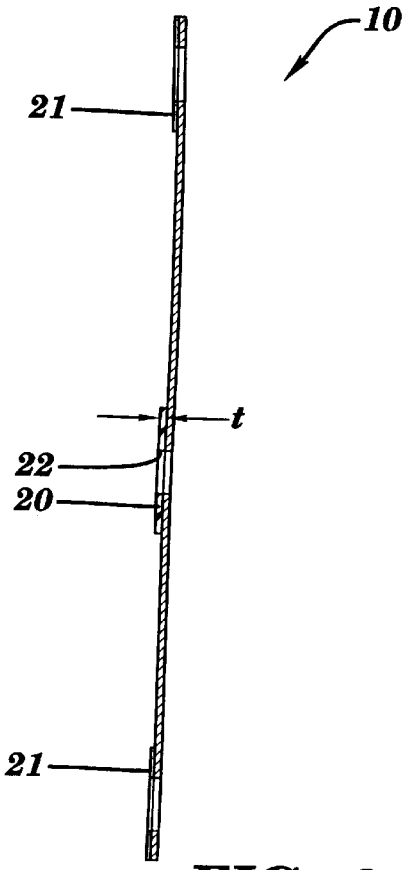
FIG. 2 is a cross-sectional view taken along 2—2 of FIG. 1.

As best shown in FIGS. 1 and 2, a pad 20 fabricated from any suitable resilient material, such as foam rubber, felt, natural or synthetic rubbers, fabric, etc., is secured in any convenient manner, such as by adhesive, hook and loop fasteners (Velcro®), staples, etc., proximate the central portion of web 14. In a preferred embodiment, as shown, pad 20 is disposed closer to fold line 26 than to either end 16. Moreover, pad 20 is preferably disposed in superposed alignment with the foldline 26, as also shown. A recess 22 is disposed within pad 20 for receiving a clasp or fastener 24 (FIG. 3) therein, as will be discussed in greater detail hereinbelow. The recess 22 may be disposed entirely within pad 20 or alternatively, may extend through web 14 as best shown in FIG. 2.

Figure 3:
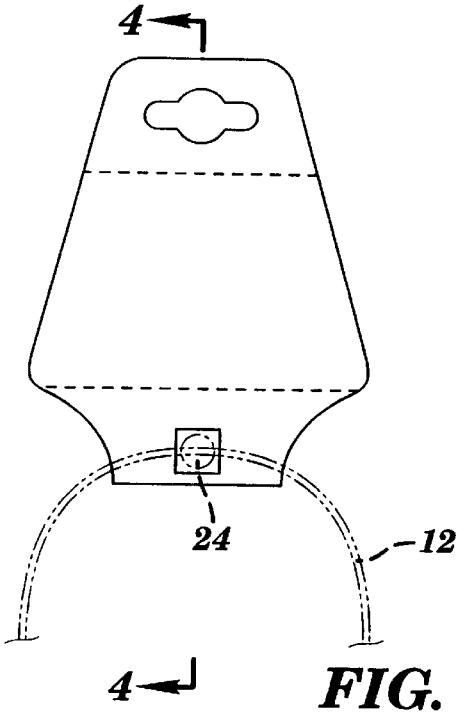
FIG. 3 is a plan view of the foldover card of FIGS. 1 and 2, shown in its folded orientation with a jewelry item disposed therein.
Figure 6:
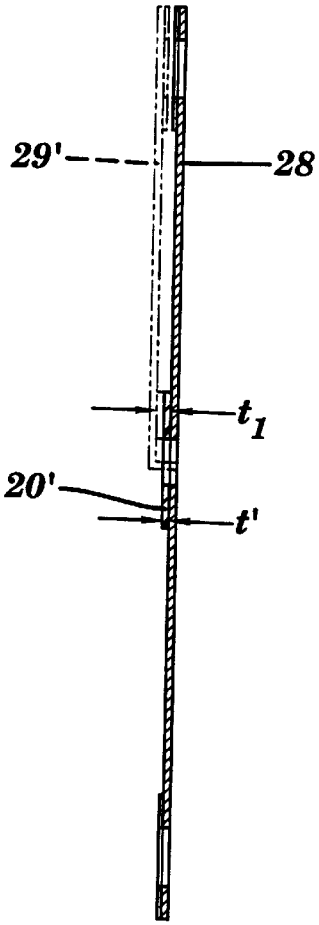
FIG. 6 is a view taken along 6—6 of FIG. 5, with a portion thereof shown in phantom in its folded orientation.

Recess 22 may be disposed substantially at any location along pad 20. For example, the recess 22 may be disposed along foldline 26 as shown in FIGS. 6 and 7, or alternatively, may be offset or disposed in spaced relation from line 26 so that the recess 22 is disposed on only a front or rear portion 28 or 29, respectively, of tag 10 when it is oriented in its folded position, as shown in FIG. 4. Pad 20 may be provided with any desired combination of thickness t and durometer hardness, predetermined to secure a jewelry item such as a necklace 12 (FIG. 3) within card 10 when the card is folded as shown in FIG. 3 and 4. For example, pad 20 may be provided with a thickness t within a range of from about 1–10 millimeters with a durometer hardness within a range of about 10–40 Shore A. As also shown, pad 20 may extend substantially continuously in the transverse direction from recess 22 to opposite edges of web 14.

Referring now to FIGS. 3 and 4, card 10 is adapted for being folded about foldline 26, as discussed hereinabove, to effectively capture a portion of a jewelry item 12, such as a necklace or bracelet, between front and rear portions 28 and 29 of card 10. As shown, the jewelry item 12 is engaged by portions of pad 20 disposed on at least one, and preferably both portions 28 and 29. Clasp or fastener 24 of jewelry item 12 is adapted for being received within recess 22. Advantageously, such receipt of clasp 24 within the recess 22, in combination with the resilient engagement of pad 20 with a portion of the jewelry item 12 sandwiched between front and rear portions 28 and 29 of the foldover card 10, serves to maintain the jewelry item 12 in proper orientation within foldover card 10 with the fastener 24 concealed therein. The present invention thus substantially eliminates the problem discussed hereinabove, of the clasp or fastener 24 sliding out of the foldover card during handling. Moreover, the present invention maintains such proper orientation of the jewelry item 12 within card 10 without relying on adhesive which tends to leave a residue or tarnish the jewelry item 12 and otherwise complicate removal of the jewelry item 12 from the card after purchase.

Furthermore, as mentioned hereinabove, recess 22 may extend through the rear portion 29 of web 14 to permit a portion of fastener 24 to extend therethrough, as best shown in FIG. 4. However, the present invention may be utilized without extending recess 22 through the web 14, as shown for example, in FIGS. 5 and 6, such as by relatively increasing thickness t of pad 20 and/or utilizing the card with jewelry items 12 having relatively smaller clasps 24. In this regard, it should be clear to one skilled in the art that the thickness t of pad 20 may be increased to effectively enlarge recess 22 either with or without extending recess 22 through one or both portions 28 and 29 of the web 14. In addition, in the event recess 22 is extended through web 14, it may be preferable to offset the recess relative to foldline 26 so that the recess is disposed entirely on one of the front and rear portions 28 and 29 respectively, i.e. on rear portion 29 as shown.

Turning now to FIGS. 5 and 6, an alternate embodiment of the present invention is shown as foldover card 10'. This embodiment is substantially identical to foldover card 10 shown in FIGS. 1–4, with the exception of utilizing an annular pad 20' superposed with a substantially continuous portion of the web 14, (i.e., so circular recess 22' does not extend through web 14). Moreover, recess 22' is superposed with foldline 26 so that the foldline substantially bisects the recess 22'. Advantageously, such placement of recess 22' along foldline 26 substantially doubles the thickness of the recess 22' from thickness t' to thickness t1 when card 10' is disposed in its folded orientation as shown partially in phantom in FIG. 6. In other words, this disposition of recess 22' along foldline 26 provides recess 22' with a folded thickness t1 which extends substantially unobstructed between front and back portions 28 and 29' for a total thickness t1 substantially equal to twice the thickness t' of pad 20'. This double thickness t1 advantageously provides additional volume for receipt of fastener or clasp 24 therein to relatively reduce or eliminate the need to extend recess 22' through one or both of front and rear portions 28 and 29', respectively. It should be clear to one skilled in the art, however, that all or a portion of recess 22' may be extended through portion 28 and/or 29' without departing from the spirit and scope of the present invention.

Turning now to FIG. 7, a further embodiment of the present invention is shown as foldover card 10". In this embodiment, pad 20" includes a plurality of pad portions formed as strips 30 and 32 disposed in spaced relation along web 14 to define a recess 22" disposed therebetween. Strips 30 and 32 operate substantially as described with respect to cards 10 and 10' hereinabove, to substantially prevent the clasp 24 from sliding laterally within card 10". In this regard, it is expected that a single strip 30 or 32 may be utilized without departing from the spirit and scope of the invention. However, use of both strips 30 and 32 is expected to achieve superior results.

While such a configuration may be adequate for many applications, in a variation of this embodiment, additional strips 34 may be disposed as shown in phantom, to substantially prevent or inhibit movement of a jewelry item 12 (FIG. 3) in the longitudinal direction. Moreover, in a further variation, recess 22", or a portion thereof as shown in phantom at 23, may extend through web 14, substantially as described hereinabove with respect to recess 22 (FIGS. 1–4).

The following illustrative examples are intended to demonstrate certain aspects of the present invention. It is to be understood that these examples should not be construed as limiting.

EXAMPLES

Example 1

A foldover card was fabricated substantially as shown and described with respect to FIGS. 1–4. The web 14 was fabricated from paperboard stock having a substantially hourglass shape as shown in FIG. 1, with a maximum longitudinal dimension of approximately 4.5 in (11.4 cm) and a maximum transverse dimension of approximately 1.75 in (4.4 cm). A resilient pad fabricated from foam rubber and having a thickness of approximately 4 mm was glued to a central portion of the web 14, with the pad extending completely across the web in the transverse direction. The pad extended in the longitudinal direction from approximately 1.75 in (4.4 cm) from one end of the web to approximately 2 in (5 cm) from the opposite end of the web 14. A recess 22 having square dimensions of approximately 0.25 in×0.25 in (0.6 cm×0.6 cm) was centrally disposed within the pad 20 and extended through the web 14. The recess was offset from centrally disposed foldline 26, so that the pad 20 partially closed the recess 22 when the card was folded as shown in FIG. 4. This foldover card was tested with a jewelry item 12 having a clasp 24 which was placed into the recess 22 substantially as shown in FIGS. 3 and 4. The foldover card successfully prevented movement of the clasp 24 out of the recess 22 during handling thereof.

Example 2

A foldover card is fabricated substantially as set forth in Example 1, but without extending the recess 22 through the web 14. In addition, resilient pad 20 is provided with a thickness of approximately 8–10 mm. This foldover card is expected to adequately maintain clasp 24 of a jewelry item 12 within the recess 22, when the card is folded about foldline 26 with opposite ends 16 fastened to one another as shown in FIG. 4.

Example 3

The foldover card 10' was fabricated substantially as shown and described with respect to FIGS. 5 and 6, having a foam rubber pad 20' fabricated as an annulus having an outer diameter of approximately 0.6–0.7 in (1.5–1.8 cm) and an inner diameter of approximately 0.2–0.3 in (0.5–0.7 cm) which defined recess 22'. The pad 20' has a thickness t' of between 0.3–0.8 mm and is centrally disposed on web 14 so that foldline 26 effectively bisects the recess 22'. The pad 20' was fastened to a continuous portion of the web 14, so that recess 22' did not extend through the web. Foldover card 10' was folded over the jewelry item 12 having a clasp 24, with the clasp 24 disposed within the recess 22'. The foldover card 10' successfully maintained the clasp within the recess during handling.

Example 4

A foldover card is fabricated substantially as set forth in Example 3, with a resilient pad fabricated from discreet strips of foam rubber substantially as show in FIG. 7. A portion of recess 22" shown as 23, is extended through the web 14. This recess portion 23 has a dimension of approximately 0.25 in×0.25 in (0.6 cm×0.6 cm). This foldover card 10" is expected to adequately secure clasp 24 within recess 22" during handling.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A package for displaying jewelry, the package comprising:

a loop-type jewelry item having a fastener portion;

a web folded to capture said loop-type jewelry item between a first portion and a second portion thereof;

at least one pad having first and second surfaces, said first surface being permanently fastened to said web between said folded first and second portions to substantially prevent access to said first surface, said at least one pad defining an opening sized and shaped to receive said fastener portion therein; and said at least one pad being disposed in squeezable engagement with said jewelry item, with said fastener portion received by said opening, to retain said jewelry item between said first and second portions.

2. The package of claim 1, wherein said web is movable between a folded position and an unfolded position to alternately engage and release the jewelry item.

3. The package of claim 1, wherein at least a portion of said opening extends through said web.

4. The package of claim 1, wherein said at least one pad comprises a single pad.

5. The package of claim 4, wherein said opening comprises an aperture disposed within said single pad.

6. The package of claim 5, wherein said aperture extends completely through said single pad.

7. The package of claim 6, wherein said aperture extends through said web.

8. The package of claim 6, wherein said aperture is superposed with a substantially continuous portion of said web.

9. The package of claim 1, wherein said at least one pad further comprises a plurality of pads.

10. The package of claim 9, wherein said plurality of pads further comprises a plurality of strips disposed in spaced relation to one another to form said opening on said web between said plurality of strips.

11. The package of claim 10, wherein a portion of said opening extends through said web.

12. The package of claim 1, wherein said at least one pad is fabricated from a resilient material.

13. The package of claim 12, wherein said resilient material is selected from the group consisting of: foam rubber, felt, natural rubber, synthetic rubber and fabric.

14. The package of claim 12, wherein said at least one pad is fabricated from a resilient material having a hardness within a range of from approximately 10 to 40 Shore A.

15. The package of claim 1, wherein said web is fabricated from a material selected from the group consisting of: paper, plastic and cardboard.

16. The package of claim 1, wherein said web is adapted for being folded along a fold line, said fold line being disposed on said web between said first portion and said second portion.

17. The package of claim 16, said fold line being disposed in a plane oriented orthogonally to said web when said web is disposed in said unfolded position, said plane extending through said recess, wherein said recess is superposed with both said first portion and said second portion when said web is disposed in said unfolded position.

18. The package of claim 16, said fold line being disposed on one side of said opening, wherein said opening is superposed with one of said first portion and said second portion when said web is disposed in said unfolded positions.

19. The package of claim 18, said extending through said pad, wherein said pad is adapted for being folded to engage opposite sides of the jewelry item when said web is folded.

20. The package of claim 19, wherein a portion of said folded pad extends in superposed relation with a portion of said opening.

21. The package of claim 1, wherein a clasp of said jewelry item is receivably disposed within said opening.

22. The package of claim 1, further comprising open sides wherein a portion of said jewelry item extends beyond said first and second portions.

23. A method for displaying jewelry, the method comprising the steps of:

(a) providing a loop-type jewelry item having a fastener portion;

(b) providing a web adapted for being folded to capture the loop-type jewelry item between a first portion and a second portion thereof;

(c) disposing at least one pad on said web, said at least one pad having first and second surfaces, the first surface being permanently fastened to the web to substantially prevent access to said first access, the at least one pad defining an opening sized and shaped to receive the fastener portion of the jewelry item therein, wherein said pad is adapted for being disposed between the folded first and second portions; and (d) placing the jewelry item between the first and second portions with the fastener portion received within the opening, wherein the jewelry item is squeezably engaged by the at least one pad.

24. A package for displaying jewelry, the package comprising:

a web folded to form an enclosure having first and second wall portions and open sides;

at least one pad disposed on said web between said folded first and second wall portions, said at least one pad being adapted to squeezably engage a portion of a jewelry item to retain the portion of the jewelry item between said first and second wall portions, wherein the jewelry item extends through said open sides of said enclosure;

said at least one pad defining an opening sized and shaped to receive another portion of the jewelry item therein;

said web being folded along a fold line disposed on said web between said first wall portion and said second wall portion, said fold line being disposed in a plane that extends orthogonally relative to at least one of said first and second wall portions, said plane further extending through said opening.

25. A package for displaying jewelry, the package comprising:

a jewelry item;

a web folded to capture said jewelry item between a first portion and a second portion thereof;

at least one pad disposed on said web between said folded first and second portions, said at least one pad defining an opening sized and shaped to receive a portion of the jewelry item therein, and wherein at least a portion of said opening extends through said web; and said at least one pad being disposed in squeezable engagement with said jewelry item to retain said jewelry item between said first and second portions.

* * * * *